US006276368B1

(12) United States Patent
Giamalva

(10) Patent No.: US 6,276,368 B1
(45) Date of Patent: Aug. 21, 2001

(54) APPARATUS FOR STYLING HAIR AND THE METHOD OF USE

(76) Inventor: Eugene S. Giamalva, 450 Raintree Ct., Unit 2 M, Glen Ellyn, IL (US) 60137

( * ) Notice: Subject to any disclaimer, the term of this patent is extended or adjusted under 35 U.S.C. 154(b) by 0 days.

(21) Appl. No.: 09/596,741

(22) Filed: Jun. 19, 2000

(51) Int. Cl.[7] ..... A45D 8/36
(52) U.S. Cl. ..... 132/201; 132/54; 132/273
(58) Field of Search ..... 132/252, 263, 132/264, 265, 270, 273, 275, 54, 200, 210, 201, 245

(56) References Cited

U.S. PATENT DOCUMENTS

| | | | | |
|---|---|---|---|---|
| 712,657 | * | 11/1902 | Davis | 132/273 |
| 971,519 | * | 10/1910 | Brannen | 132/273 |
| 3,126,018 | * | 3/1964 | Sidelman | 132/54 |
| 3,623,491 | * | 11/1971 | Garrett | 132/245 |
| 5,165,429 | * | 11/1992 | Miller | 132/263 |
| 5,706,837 | * | 1/1998 | Iwata | 132/54 |
| 5,769,101 | * | 6/1998 | Iwata | 132/273 |
| 5,937,867 | * | 8/1999 | Williams | 132/275 |
| 5,950,637 | * | 9/1999 | Chang | 132/54 |
| 6,142,159 | * | 11/2000 | Lloyd | 132/273 |

* cited by examiner

*Primary Examiner*—Todd E. Manahan
(74) *Attorney, Agent, or Firm*—Robert L. Marsh

(57) ABSTRACT

The inventive apparatus and method allow unskilled users to create attractive and intricate hairstyles easily and quickly. The apparatus is generally cylindrical in shape, is hollow, and has open ends. The apparatus is provided with a longitudinal split, allowing the cylinder to be opened and placed about the base of a pony tail. In use, the apparatus surrounds the pony tail adjacent to the wearer's scalp, and the pony tail extends completely through its interior, generally in parallel with the longitudinal axis of the cylinder. The inner surface of the apparatus is provided with a plurality of radically extending tines. The tines extend into the pony tail to provide a means for retaining the apparatus adjacent to the scalp. The apparatus is further provided with a plurality of holes within the wall of the cylinder. The holes are placed about the entire surface of the cylinder and are sized to allow the wearer to draw strands of hair through the wall of the cylinder from the interior of the cylinder to the exterior. A second series of holes, much smaller than the first series, is provided about the entire surface of the cylinder. This second series of holes is intended to receive the posts of decorative members, such as faux or genuine jeweled pins or earrings, as a means of embellishment of the apparatus, and thus the hairstyle. The apparatus will be provided in a variety of sizes and proportions so as to best accommodate a wide variety of hairstyles.

19 Claims, 9 Drawing Sheets

FIG. 18
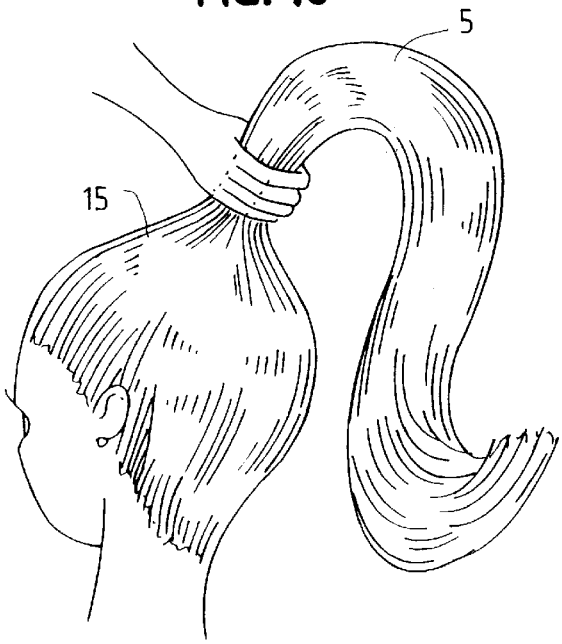
FIG. 19
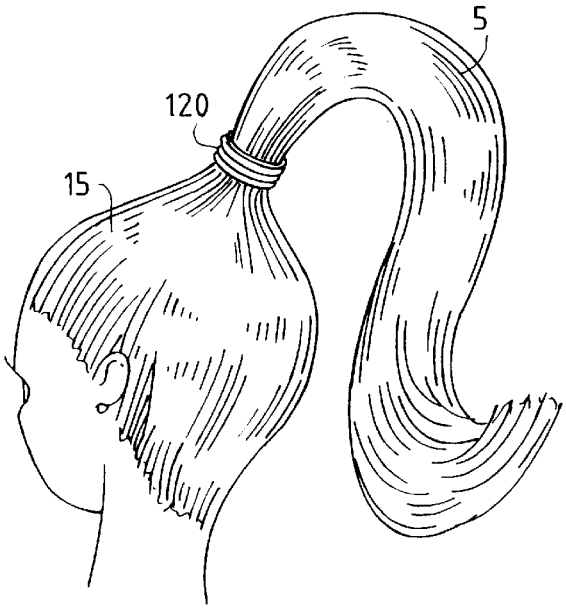
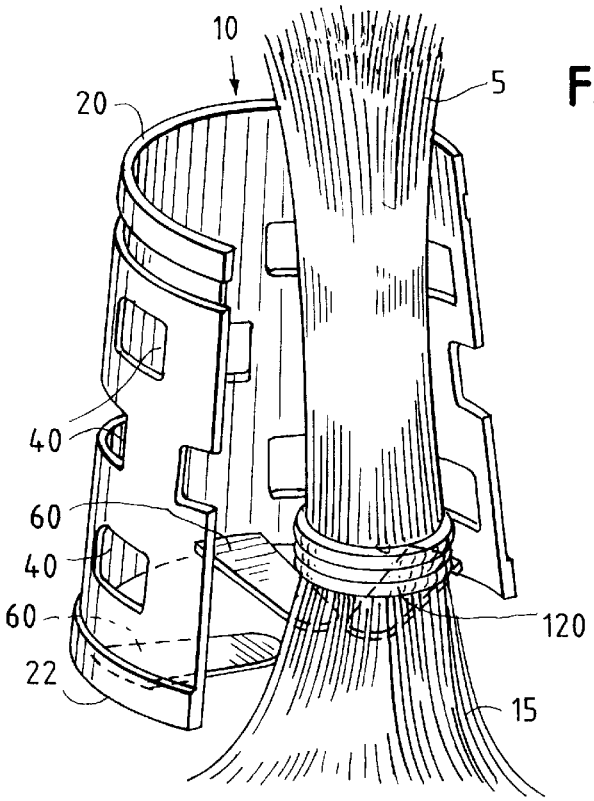
FIG. 20

APPARATUS FOR STYLING HAIR AND THE METHOD OF USE

This invention relates to an apparatus used to create an attractive hair styles and the method of creating it. Specifically, the inventive apparatus and method are used to create and maintain a variety of up dos type hair styles by encircling a pony tail with the inventive apparatus.

BACKGROUND OF THE INVENTION

Hair styling has been an important feature of personal grooming throughout the history of human kind. Although many currently popular styles and techniques, such as curling, braiding, and knotting, have been employed for hundreds of years, the pony tail is a relatively recent invention. Formed by gathering together portions of all of a person's hair and securing the gathered strands with an elastic band, the pony tail is the basis of many different hairstyles which range from very simple to extremely intricate. A basic pony tail hairstyle is easy to create and is popular among persons of all ages. However, elaborations on this basic hairstyle are not usually attempted by the lay person. When a more sophisticated or intricate hairstyle is desired, the lay person usually visits a hair salon and pays an experienced hair stylist to provide the desired style. This can be very costly and time consuming.

SUMMARY OF THE INVENTION

The inventive apparatus and method allow even unskilled users to create attractive and intricate hairstyles easily and quickly. Beginning with all or portions of the hair gathered into a basic pony tail, the apparatus and method of employing it allow the user to create a wide variety of hairstyles, and also allow the user to embellish the hairstyle by adding decorative elements to the apparatus, if desired.

The inventive apparatus is a multipurpose hair styling tool, which can also be used as a decorative compliment to the overall stylistic appearance of the wearer. It can be used to elevate and add volume to the basic pony tail. It can also be used to create an infinite variety of up-do-type hairstyles which use the pony tail as a basic starting point. The inventive apparatus can also be used as fastening hardware for mounting faux hair pieces, millenary, bridal crowns and veils, tiaras and crowns to the hair of the wearer.

The inventive apparatus is generally cylindrical in shape, is hollow, and has open ends. The cylinder is provided with a longitudinal split, allowing the apparatus to be opened and placed about the base of the pony tail. In use, the cylinder surrounds the pony tail adjacent to the wearer's scalp, and the pony tail extends completely through the interior of the cylinder, generally in parallel with the longitudinal axis of the cylinder.

The inner surface of the cylinder is provided with a plurality of radially extending tines adjacent to the bottom edge of the cylinder. The tines extend into the pony tail, between the elastic band and the wearer's scalp, to provide a means for retaining the apparatus adjacent to the scalp. The apparatus is further provided with a plurality of holes within the wall of the cylinder. The holes are placed about the entire surface of the cylinder and are sized to allow the wearer to draw strands of hair through the wall of the cylinder from the interior of the cylinder to the exterior. A second series of holes, much smaller than the first series, is also provided about the entire surface of the cylinder. This second series of holes is intended to receive the posts of decorative members, such as faux jewel pins or earrings, as a means of embellishment of the apparatus, and thus the hairstyle.

The apparatus will be provided in a variety of sizes and proportions so as to best accommodate a wide variety of hairstyles. Multiple short cylinders of small diameter may be used simultaneously in an adult's hair, while a single short cylinder might be appropriate for the wispy hair of a small child. A single, larger cylinder having a diameter to height ratio of approximately 1.5 to 2 is the preferred embodiment. For more bold applications, a still larger and more elongate cylinder having a diameter to height ratio of approximately 1 to 2 may be employed. To improve the aesthetic appearance of the largest cylinders, a slight tapering of the cylinder from bottom to top may be provided.

A method of using the inventive apparatus is provided.

BRIEF DESCRIPTION OF THE DRAWING

FIG. 18 illustrates the method step wherein all or portions of hair are gathered together with the hand;

FIG. 19 illustrates the method step wherein the gathered hair is surrounded with an elastic band to form a pony tail;

FIG. 20 illustrates the method step wherein the opened apparatus is placed about the pony tail such the tines of the apparatus are inserted between the elastic band and the wearer's scalp;

DETAILED DESCRIPTION OF THE PREFERRED EMBODIMENT

Figure 1:
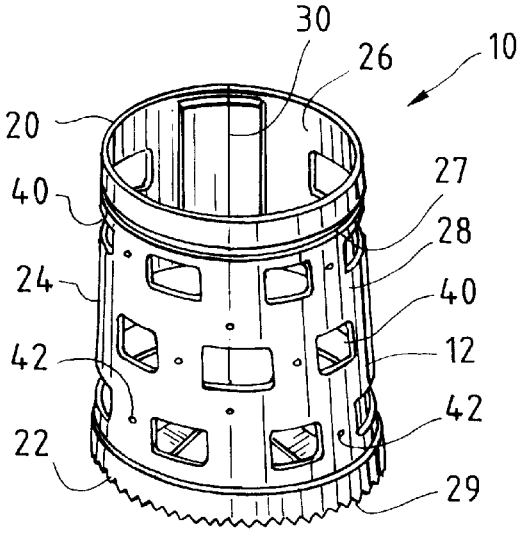
FIG. 1 is a side perspective view of the apparatus illustrating the hollow cylindrical shape and open ends, and showing one possible configuration of large and small holes about the surface.

The preferred embodiment of the inventive apparatus 10 is illustrated in FIG. 1. The apparatus is generally cylindrical in shape and is hollow. The hollow cylinder has a top end 10, a bottom end 22, and a mid portion 24 which extends between the top end 20 and bottom end 22. The top 20 and bottom 22 ends of the cylinder 12 are open so that hair may extend completely through the hollow interior of the cylinder and out of each respective end 20, 22.

Figure 2:
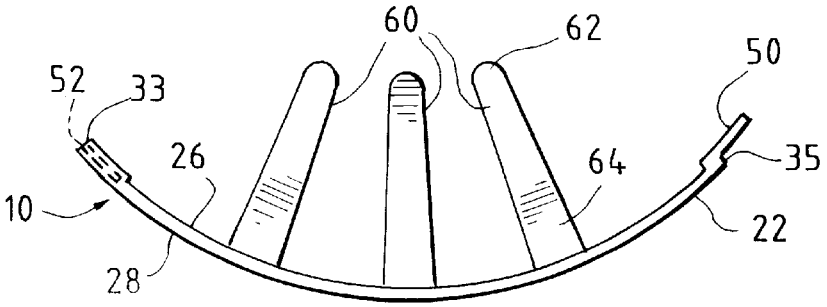
FIG. 2 is a bottom end view of the apparatus in a generally open curve configuration, illustrating that the tines are separated when the apparatus is in this configuration. This figure also illustrates the method step wherein the apparatus is forced open prior to application to the pony tail.

Cylinder 12 comprises a wall, the wall having an inside surface 26, an outside surface 28, and a longitudinally aligned spit 30 which allows the cylinder to be forced open into a generally open curve configuration as illustrated in FIG. 2. This open curve configuration allows apparatus 10 to be placed around a portion of hair that has been tightly gathered, as in the case of a pony tail. When released from the open curve configuration, apparatus 12 self-regains its cylindrical shape, and thus completely surrounds the gathered portion of hair.

The edge surface of bottom end 22 of cylinder 12 provided with short, longitudinally extending ridges or teeth. These ridges or teeth lie against the scalp and prevent apparatus 10 from rotating about the gathered portion of hair.

Figure 3:
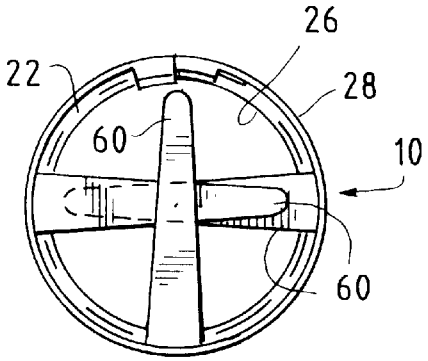
FIG. 3 is a bottom end view of the apparatus in a closed, cylindrical configuration showing how the tines extend radially nearly completely across the interior space of the cylinder, and are arranged in an overlapping manner.
Figure 4:
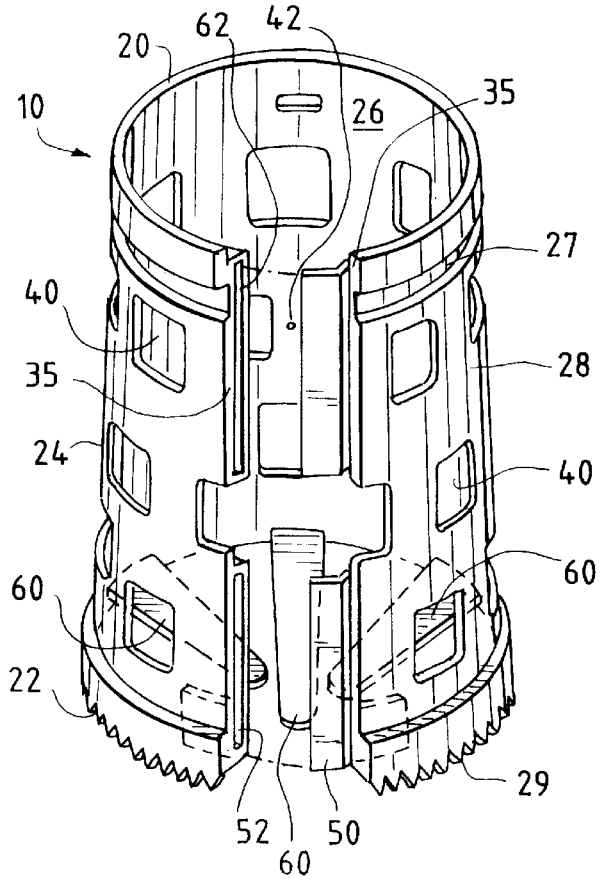
FIG. 4 is a side perspective view of the apparatus in a slightly opened configuration, illustrating the use of snap fit tabs as a selective closure means.

Cylinder 12 is provided with a plurality of radially extending tines 60 along its inside surface 26 adjacent to the bottom end 22. Each tine 60 is provided with a tapered, rounded tip 62 and a base 64 which is integral with the inside surface 26. Each tine 60 has a length which is greater than the radius of cylinder 12 but less than the diameter of cylinder 12 so that it extends nearly completely across the hollow interior of cylinder 12. Tines 60 are generally adjacent the bottom end 22 of cylinder 12 but placed in a vertically staggered manner along the inside surface 26 so that the respective tines 60 closely overlap each other but do not interfere with each other when apparatus 10 is cylindrical in configuration, as illustrated in FIG. 3.

Tines 60 are used to maintain the position of apparatus 10 in the hair once it has been placed there. In use, cylinder 12 is forced into a generally open curve configuration, which causes the respective tines 60 to be drawn apart so that they no longer overlap each other, as shown in FIG. 2. Apparatus 10 is then oriented such that the bottom end 22 is placed adjacent the scalp 15, and tines 60 are inserted into the bundled hair strands such that tines 60 extend between the scalp 15 and the elastic band 120 used to form the pony tail (FIG. 20). Apparatus 10 is then allowed to return to its cylindrical configuration resulting in the plurality of tines 60 regaining its overlapping configuration (FIG. 3) within the pony tail.

Cylinder 12 is formed of a rigid material which is sufficiently flexible so as to allow it to be opened into a generally curved configuration when a moderate separating force is applied to respective first 33 and second 35 edges of split 30, which is sufficiently elastic so as to allow it to self-regain its cylindrical configuration when the above mentioned force is removed. Preferably, apparatus 10 is formed of plastic, but it is within the scope of this invention to form it from other materials which can provide the required properties.

Although the elastic properties of apparatus 10 are sufficient to maintain it in a cylindrical configuration, a means for selective closure is provided along longitudinal split 30. The means for selective closure allow the user to selectively maintain the apparatus 12 in a closed, cylindrical configuration such that first 33 and second 35 edges are maintained in abutting contact. In the preferred embodiment, the means for selective closure include at least one tab 50 extending from second edge 35 in a circumferential direction, and further include at least one recess 52 formed in the first edge 33 which is aligned with tab 50 and sized and shaped to receive tab 50 therewithin in a snap-fit relationship. In the preferred embodiment, at least two tabs 50- and recess 52-pairs are provided along the respective first 33 and second 35 edges. It is within the scope of the invention, however, to use fewer or greater numbers of tab-recess pairs, or to substitute other means for selective closure for the snap-fit closure described herein.

Figure 21:
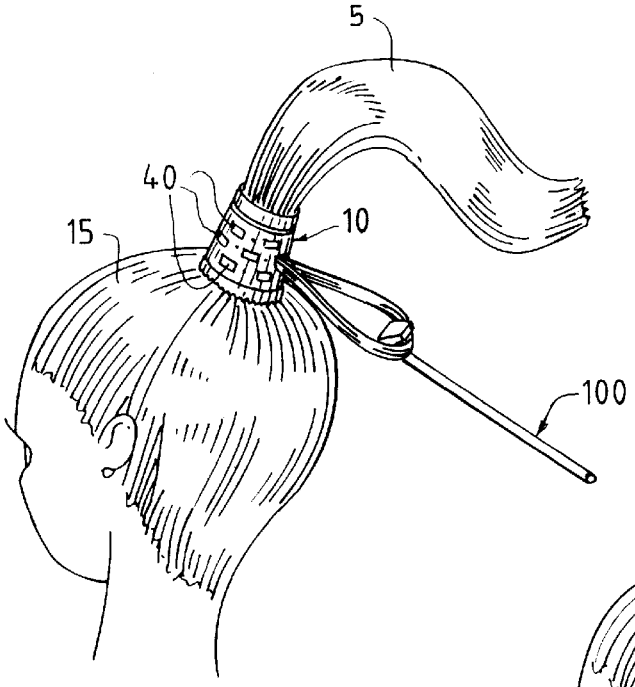
FIG. 21 illustrates the method steps wherein a hook is inserted into one of the large holes in the cylinder wall, the hook is caused to hook multiple strands of hair, and then the hook is withdrawn from the large hole while drawing the multiple strands of hair from the interior of the cylinder to the exterior of the cylinder.
Figure 22:
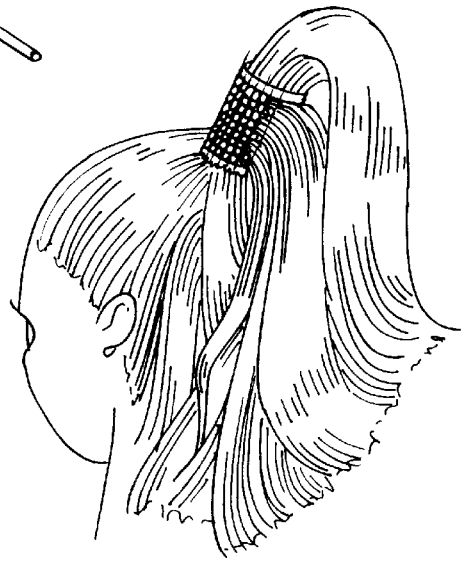
FIG. 22 is a rear perspective view of a wearer's head showing the inventive apparatus employed with a completed hair style.
Figure 23:
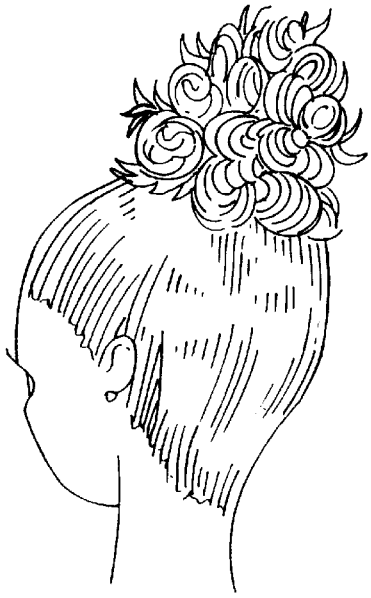
FIG. 23 is a rear perspective view of a wearer's head showing another completed hair style employing the inventive apparatus.

A plurality of primary holds 40 is provided in the mid portion 24 of cylinder 12. Primary holes 40 extend completely through the cylinder wall. They are sized to allow a hair hook 100 to pass therethrough and be withdrawn while hooking multiple strands of hair (FIG. 21). Primary holes 40 may be circular, rectangular, or irregular in shape. Primary holes 40 may be arranged about the surface of cylinder 12 in a geometric pattern, or may be randomly arranged thereon. The quantity and arrangement of primary holes 40 is determined by aesthetic appearance.

Figure 9:
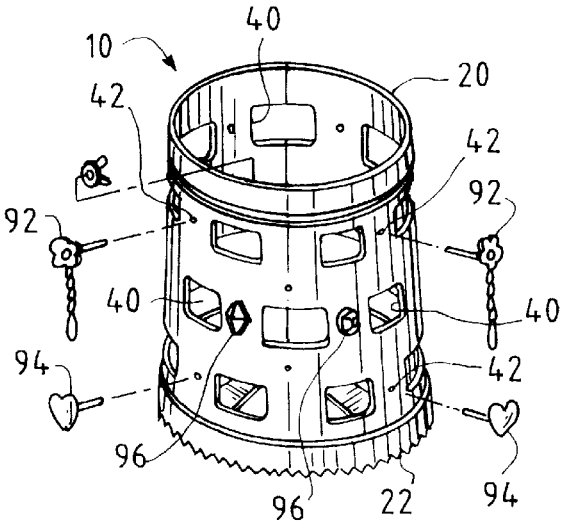
FIG. 9 is a front side perspective view of the apparatus, illustrating pendant earrings and drop earrings being inserted into the smaller series of holes for the purpose of decorating the apparatus.

A plurality of secondary holes 42 is provided in the mid portion 24 or cylinder 12 which also extend completely through the cylinder wall. Secondary holes 42 are much smaller than primary holes 40, and are sized to receive the stud of an earring or decorative pin therewithin. Employment of secondary holes 42 allows the wearer to decorate the apparatus with favorite jewelry, and to coordinate apparatus 10 with individual wardrobe choices. Such embellishment of apparatus 10 is illustrated in FIG. 9, where drop-style earrings 92, diamond stud earrings 96, and heart pendant earrings 94, are mounted in secondary holes 42.

Figure 14:
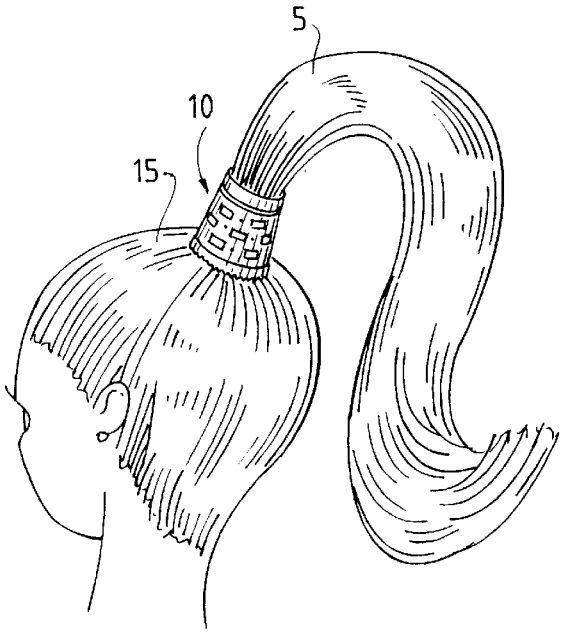
FIG. 14 is a rear perspective view of the wearer's head showing the inventive apparatus surrounding a pony tail to create one basic up do hairstyle, and also illustrates the method step wherein the apparatus is closed about the gathered hair, allowing the tabs to snap fit within the tube recesses.
Figure 15:
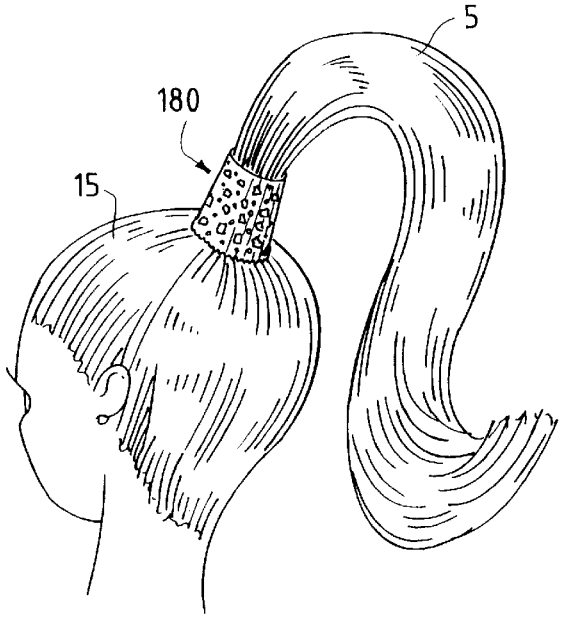
FIG. 15 is the same view and hair style as shown in FIG. 14, with the addition of a decorated overlay in place over the inventive apparatus, and also illustrates the method step of applying a decorated overlay to the inventive apparatus.
Figure 16:
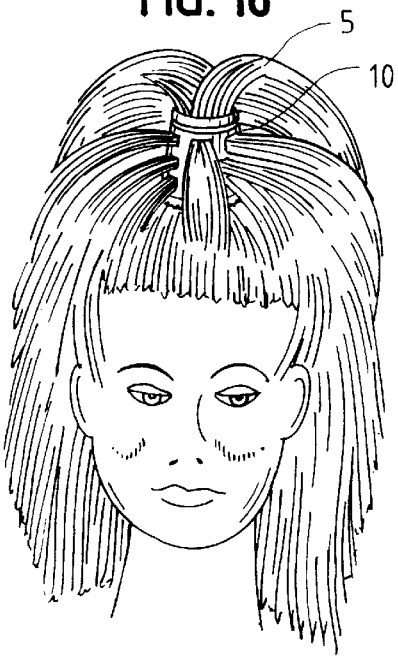
FIG. 16 is a front view of the wearer's head showing the inventive apparatus with hair pulled through the larger series of holes in the wall of the cylinder to create an innovative hair style as shown in detail in FIG. 13.
Figure 17:
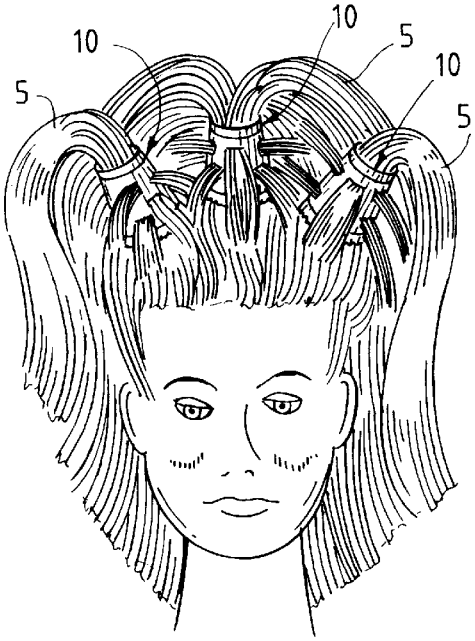
FIG. 17 is a front view of the wearer's head showing multiple inventive apparatus used simultaneously.

Apparatus 10 will be provided in a variety of sizes and proportions so as to best accommodate a wide variety of hairstyles, some of which are illustrated in FIGS. 16, 17, 22 and 23. The preferred proportions are a diameter to height ratio of approximately 1.5 to 2. It is completely within the scope of the invention, however, to vary these proportions to accommodate the specific requires of the wearer. For instance, increasing the height of cylinder 12 without increasing the diameter creates a "tower" effect, and may be useful in creating very dramatic hairstyles. A slight tapering of the cylinder from bottom to top is provided to improve the aesthetic appearance. Reducing the height of the cylinder 12 without decreasing the diameter provides a more low key look than the preferred embodiment. A single apparatus 10 may be used to provide an innovate hair style (FIGS. 14, 15, 16), or a multiple apparati 10 may be employed simultaneously (FIG. 17).

In the preferred embodiment, apparatus 10 is provided with an outside surface 28 which is smooth and unadorned. However, it is within the scope of the invention to provide outside surface 28 with a contoured shaped and/or to apply a surface finish which gives outside surface 28 an attractive, finished appearance. By providing outside surface 28 with such an appearance, apparatus 10 can be used as a jewelry piece for the hair, in addition to being a tool for creating hairstyles.

Figure 7:
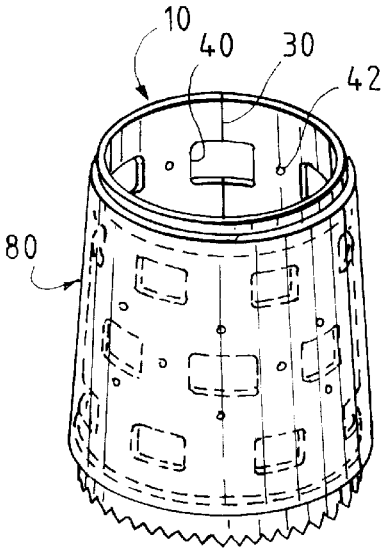
FIG. 7 is a front side perspective view of the overlay and illustrates the overlay surrounding the apparatus, where the apparatus is shown in phantom.
Figure 8:
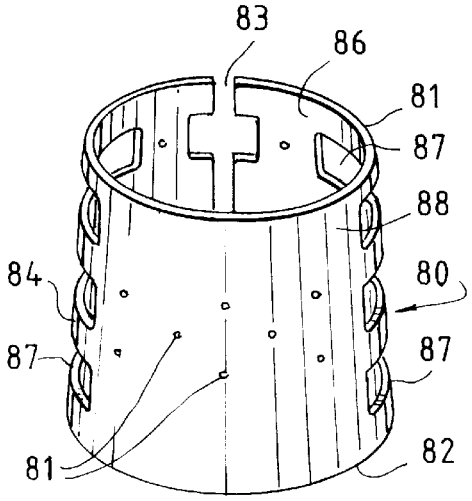
FIG. 8 is a front side perspective view of the overlay, showing large and small holes positioned about the surface of the overlay and the longitudinal split which allows the overlay to be opened.

As an alternative to decoratively finishing outside surface 28 of apparatus 10, overlay 80 (FIGS. 7, 8, 10) is provided as an accessory to apparatus 10. Overlay 80 is formed of a thin cylindrical sheath of plastic having a longitudinally aligned split 83. Overlay 80 has a top edge 81, a bottom edge 82, and a mid portion 84 which extends between the top edge 81 and bottom edge 82. Overlay 80 has an inside surface 86 and an outside surface 88. In use, overlay 80 is placed in an overlying manner about apparatus 10 such that the overlay 80 has an inside surface 86 in a confronting adjacent relationship with apparatus outside surface 28. Overlay 80 has generally the same or slightly greater dimensions as apparatus 10 so that when overlay 80 is in place over apparatus 10, apparatus 10 is not seen by persons viewing the wearer.

Figure 13:
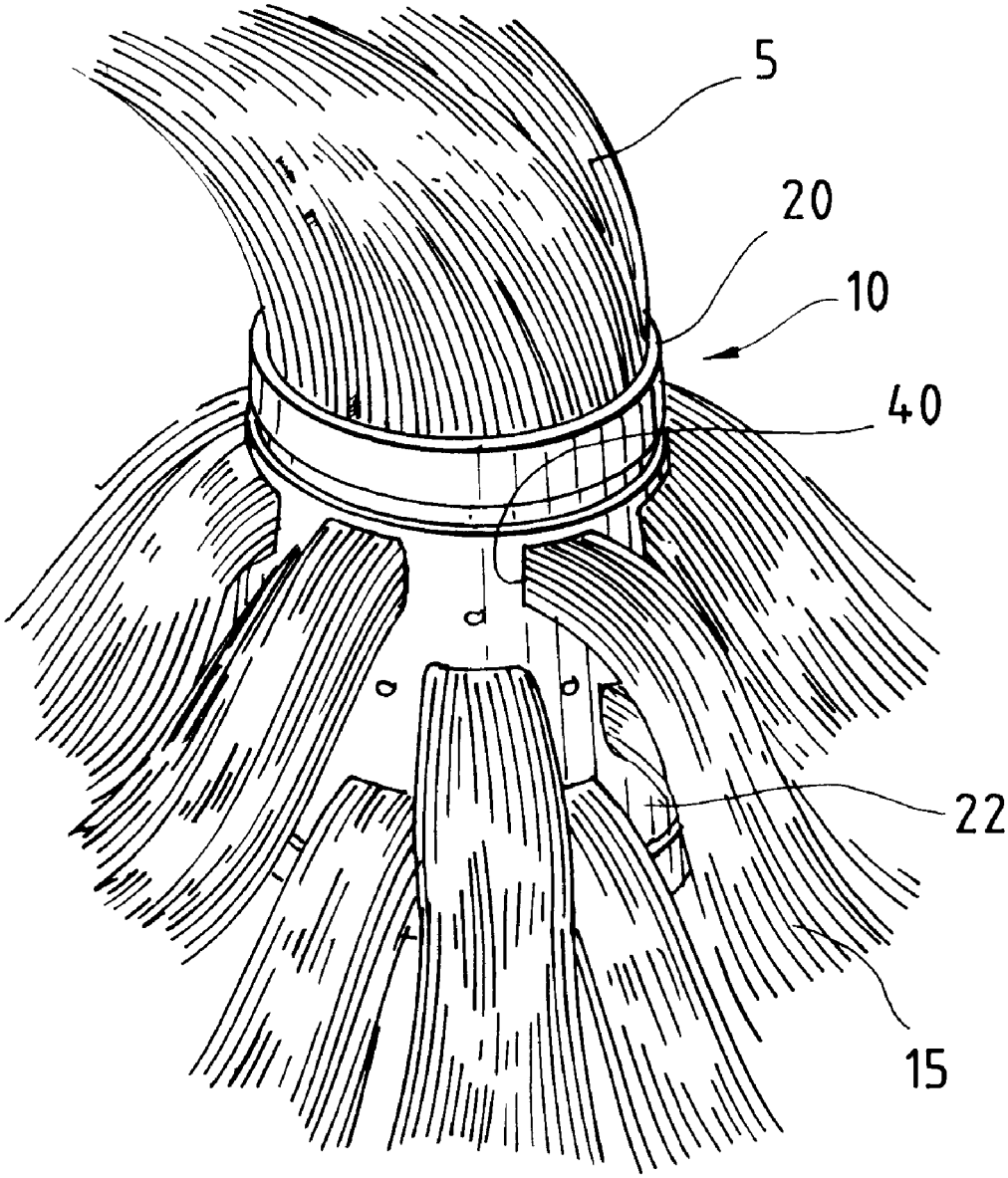
FIG. 13 illustrates the apparatus with hair pulled through the larger series of holes in the wall of the cylinder to create an innovative hair style.

Overlay 80 is provided with a plurality of primary holes 87 about its mid portion 84. Preferably, primary holes 87 are sized and positioned about overlay 80 so as to overlie and be aligned with primary holes 40 of apparatus 10 when overlay 80 is placed about apparatus 10. This configuration allows hair hook 100 to pass therethrough and be withdrawn while hooking multiple strands of hair (FIG. 13). Primary holes 87 may be circular, rectangular, or irregular in shape. Primary holes 87 may be arranged about the surface of overlay 80 in a geometric pattern, or may be randomly arranged thereon. Preferably, primary holes 87 are formed only on the sides and rear of overlay 80 providing a larger uninterrupted decorated surface at the front side of the overlay. It is within the scope of the invention, however, to provide primary holes 87 in the same number, quantity, and arrangement as is provided on apparatus 10, the quantity and arrangement of primary holes 87 being determined by aesthetic appearance.

A plurality of secondary holes 89 are provided in the mid portion 84 of overlay 80. Secondary holes 89 are much smaller than primary holes 87, and are sized to receive the stud of an earring or decorative pin therewithin. Secondary holes 89 are positioned about overlay 80 so as to overlie and be aligned with secondary holes 42 of apparatus 10 when overlay 80 is placed about apparatus 10. As with apparatus secondary holes 42, employment of secondary holes 89 in overlay 80 allows the wearer to decorate the overlay 80 with favorite jewelry, and to coordinate overlay 80 with individual wardrobe choices.

Figure 10:
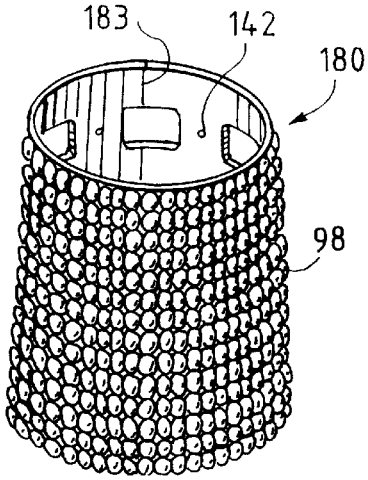
FIG. 10 is a front side perspective view of an overlay which is covered in beads as an illustration of one of many possible ways of decorating the overlay.

In the preferred embodiment, overlay 80 is provided to the user in a neutral color or may be transparent. It is provided to the user undecorated and unadorned for use as a means for the user to personalize and decorate apparatus 10. The wearer may paint overlay 80 or may cover overlay 80 with any material, including, but not limited to, paper, fabric, leather, and/or foils. The wearer may choose to attach decorative elements to the surface of overlay 80 which include, but are not limited to, faux or real jewels, leather, sequins, ribbon, cord, feathers, button's and/or beads (FIG. 10). Alternatively, overlay 80 may be provided to the user in decorated form.

Figure 5:
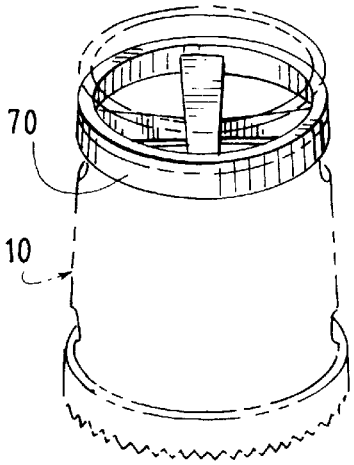
FIG. 5 is a side perspective view of the cinch and illustrates the chinch encircling the apparatus and residing in the circumferencial groove adjacent the top end of the apparatus, where the apparatus is shown in phanthom.

Cinch 70 (FIGS. 5 and 6) is provided as an accessory to apparatus 10 and is used to secure artificial hair falls within apparatus 10 when used. Cinch 70 also acts to reinforce the means for selective closure so that when in place encircling apparatus 10, first edge 33 of apparatus split 30 can not be separated from its second edge 35. Cinch 70 is a thin circular band and has a first end 72 which abuts its second end 74, and a circular mid portion 75 which connects first end 72 to second end 74. Cinch 70 has an inside surface 76 and an outside surface 78. When in use, inside surface 76 is in a confronting adjacent relationship with apparatus outside surface 28.

Figure 6:
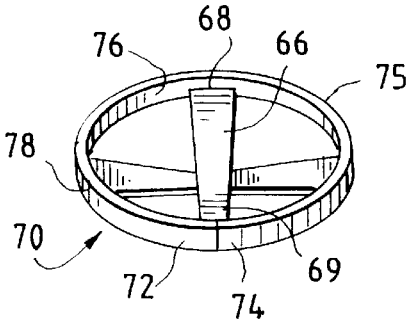
FIG. 6 is a side perspective view of the cinch illustrating that the chinch also has tines extending radially inward from its inner surface.

Cinch 70 is provided with a plurality of radially extending tines 66 along its inside surface 76. Cinch tines 66 are used to maintain the position of apparatus 10 in the hair once it has been placed there. Each cinch tine 66 is provided with a tapered, rounded tip 69 and a base 68 which is integral with the inside surface 76. Each cinch tine 66 has a length which is greater than the radius of cinch 70 but less than the diameter of cinch 70 so that it extends nearly completely across the inner diameter of cinch 70. Cinch tines 66 are placed in a slightly vertically staggered manner along the inside surface 76 so that the respective tines 66 closely overlap each other but do not interfere with each other when cinch 70 is circular in configuration, as illustrated in FIG. 6.

In use, cinch 70 is forced into a generally open curve configuration, which causes the respective cinch tines 66 to be drawn apart so that they no longer overlap each other. Cinch 70 is then placed within circumferential groove 27 of apparatus 10 such that the inside surface 76 of cinch 70 lines in a confronting relationship with the outside surface 28 of apparatus 10. Circumferential groove 27 is formed within outside surface 28 adjacent to the top 20 of apparatus 10 and has a depth sized to receive cinch 70 therewithin such that the outer surface 78 of cinch 70 lies flush with outer surface 28 of apparatus 10. The width of circumferential groove 27 is sized to receive the width of cinch 70 with little or no gap therebetween. Circumferential groove 27 is provided with cinch tine holes 73 sized and positioned to receive cinch tines 66 therethrough. Once placed within circumferential groove 27, cinch 70 is allowed to return to its circular configuration, resulting in chin 70 residing within circumferential groove 27 and encircling apparatus 10, and further resulting in a plurality of cinch tines 66 regaining the overlapping configuration as shown in FIG. 6.

Cinch 70 is formed of a rigid material which is sufficiently flexible so as to allow it to be opened into a generally curved configuration when a moderate separating force is applied to respective first 72 and second 74 ends, and which is sufficiently elastic so as to allow it to self-regain its circular configuration when the above mentioned force is removed. Preferably, cinch 70 is formed of plastic, but it is within the scope of this invention to form it from other materials which can provide the required properties.

The inventive apparatus 10 and accessories may be provided as a hair styling kit. A basic hair styling kit would have the following elements included:

A. At least one apparatus 20 (including cinch 70). In the preferred embodiment, three apparati of varying sizes are provided.

B. At least one hair hook 100. Similar to a crochet hook, a hair hook is a thin, elongate rod having one end bent back on itself to form a hook. This hook is used to draw strands of hair from primary holes 40.

C. At least six blank, or unadorned, overlays 80.

D. An instruction booklet 130 which includes step by step instructions and illustrations for creating several hairstyles using the accompanying tools.

Figure 11:
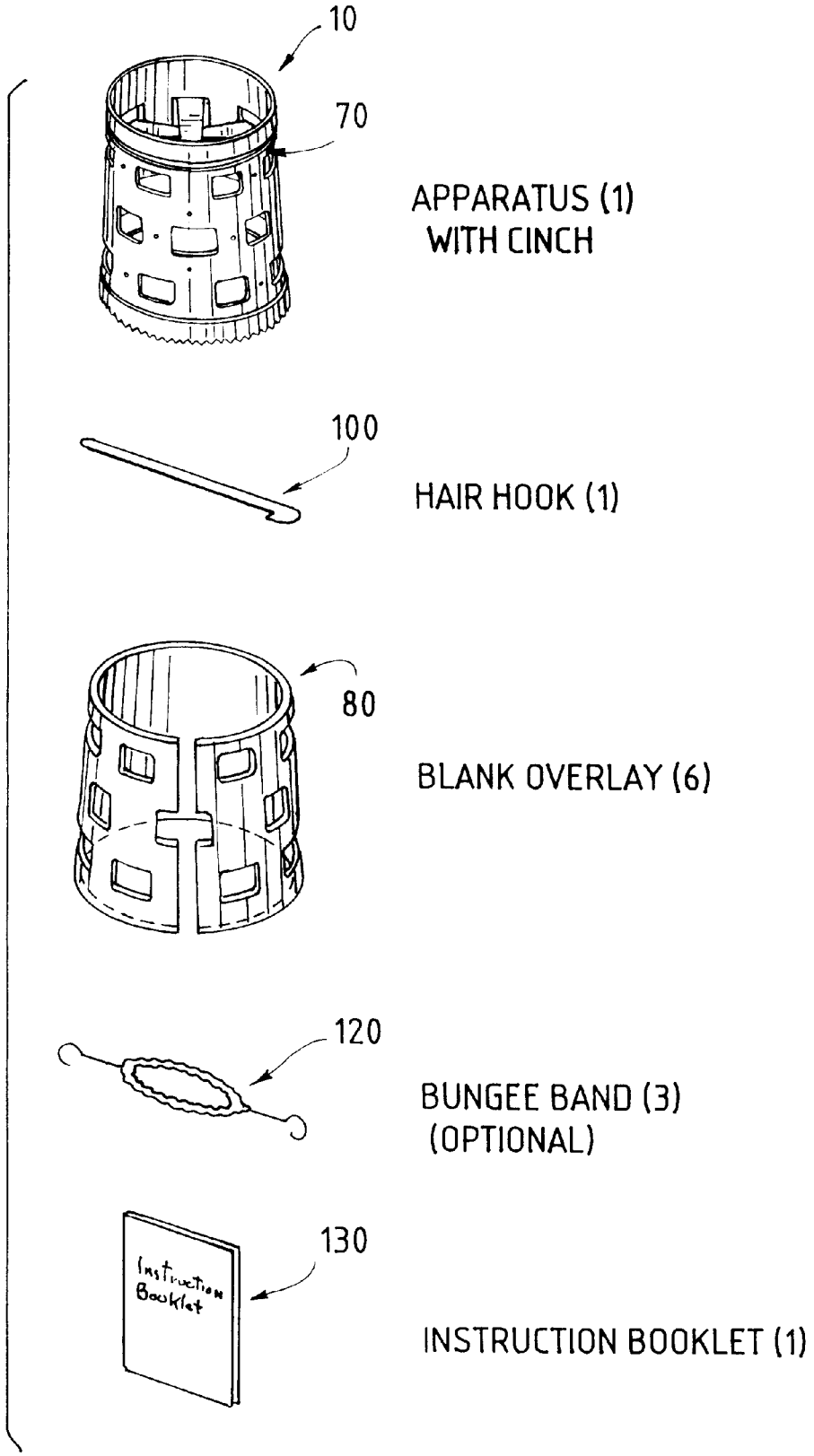
FIG. 11 illustrates the preferred embodiment of a basic kit, and includes at least one apparatus with cinch, one hair hook, at least six blank overlays, and an instruction booklet.
Figure 12:
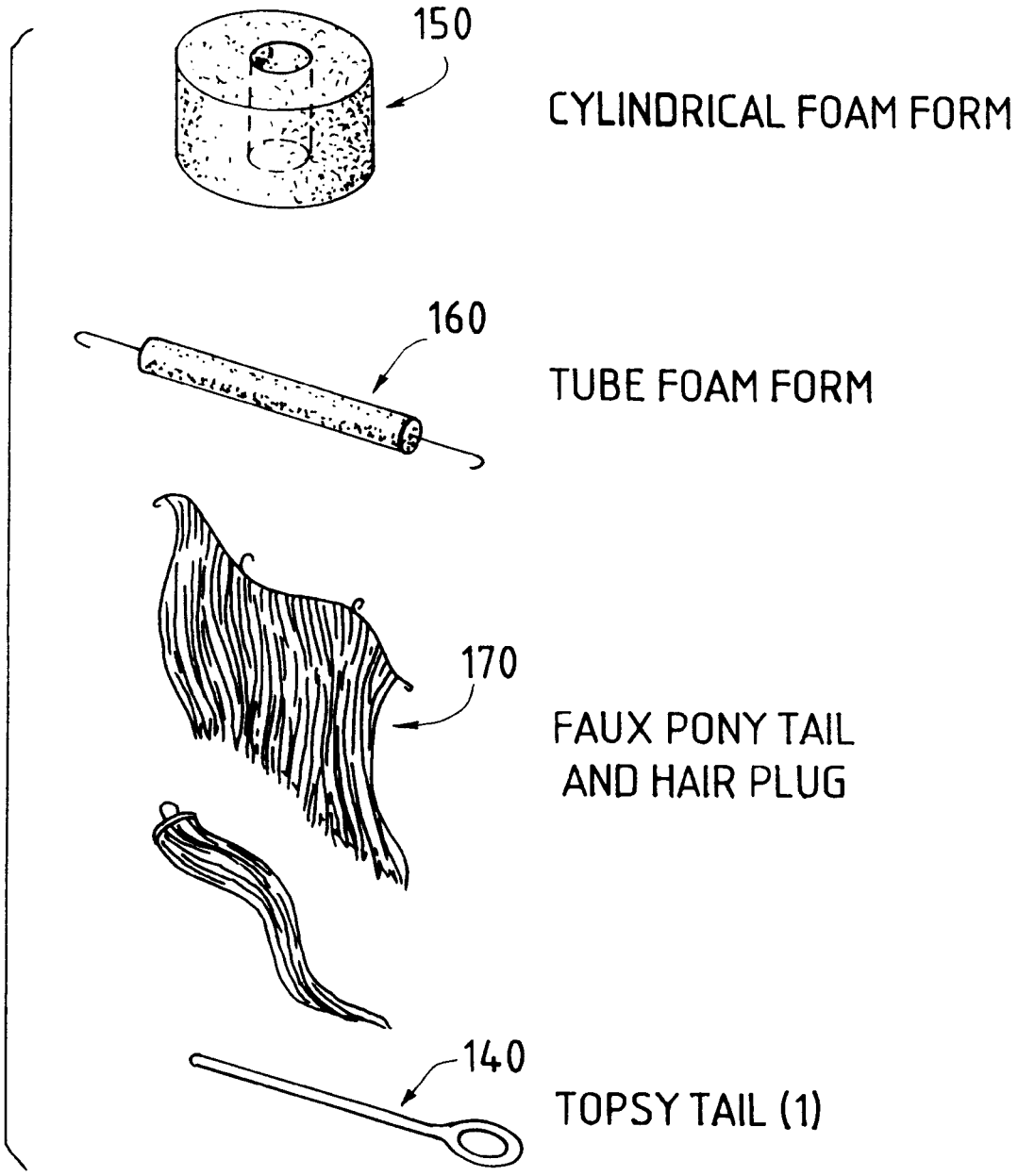
FIG. 12 illustrates elements which may be added to the basic kit to form an expanded kit, and includes at least one cylindrical foam form, at least one tube foam form, at least one faux pony tail addition, at least one hair plug, and a Topsy Tail™.

E. At least three elastic bands 120 (included optionally, since these are found conventionally). These bands may be a simple elastic circlette, may be cloth covered to protect the hair, and/or may be provided with a pair of opposing hooks as found on bungee band ties, illustrated in FIG. 11.

An expanded hair styling kit would include the above mentioned elements, and would also include, but not be limited to, elements selected from the following list:

F. At least one cylindrical foam form 150. Used by placing the hollow center of the foam core about the outside of apparatus 10, and then wrapping hair about the foam form in a conventional manner, the cylindrical foam form can be provided in a variety of sizes.

G. At least one tube foam form 160. Used by bending the foam form about the outside of apparatus 10 and hooking thereon, and then wrapping the wearer's own hair or a faux pony tail about the foam form in a conventional manner, the stick foam form can be provided in a variety of sizes.

H. At lest one real or faux pony tail having one or more hair plugs 170 for providing extension and for volumizing the hair.

I. A Topsy-Tail™ 140 to increase the number and variety of hairstyles available for creation using the accompanying tools.

Method steps for using the inventive apparatus and the various accessories to create an up do hair style are provided as follows:

1. Gather a portion of hair together.

2. Maintain the portion of hair in a gathered relationship by surrounding the portion of hair with an elastic band, the elastic band being placed adjacent to the scalp of the head of the wearer.

3. Force open cylinder 12 to a generally open curved configuration such that the means for selective securement are detached and separated from one another, and the plural tines 60 are drawn apart so that the plural tines 60 no longer overlap each other.

4. Place cylinder 12 about the gathered portion of hair by surrounding the gathered portion of hair with cylinder 12 by allowing it to return to its cylindrical configuration such that the gathered portion of hair resides within and extends in parallel with the longitudinal centerline of cylinder 12. Cylinder 12 is oriented on the gathered portion of hair such that said bottom end 22 resides adjacent the scalp and the plural tines 60 extend into the gathered portion of hair such that they reside between the elastic band and said scalp.

5. Secure the means for selective securement such that said first edge 33 of cylinder 12 is maintained in an abutting relationship with the second edge 33 of said cylinder 12. In the preferred embodiment, this is accomplished by inserting each tab 50 into the respective tab recess 52 until the tap snaps into locked position.

6. Place overlay 80 in an overlying relationship with cylinder 12 such that overlay 80 surrounds and covers cylinder 12.

7. Insert hair hook 100 through one of the plural primary holes 40.

8. Hook plural strands of hair with hair hook 100.

9. Withdraw hair hook 100, along with the hooked strands of hair, from the interior of cylinder 12 so that the strands of hair extend through the primary hole 40.

10. Repeat steps 6–8 until strands of hair have been withdrawn from each of the primary holes 40.

In cases where cinch 70 is required to ensure that a faux pony tail is maintained within apparatus 10, the following method steps 11–13 are added following method step 9:

11. Open cinch 70 to a generally linear configuration.

12. Place cinch 70 adjacent to the top of cylinder 12, inserting cinch tines 66 within cinch tine holes 79 of circumferential groove 29.

13. Release cinch 70, allowing cinch 70 to return to its circular configuration and encircling cylinder 12.

Using apparatus 10 in concert with the above described method steps allows even a non-professional to create elaborate and elegant up do hair styles. The type and variety of hair styles possible to create when using this apparatus and method are infinite, and are not limited by the illustrations provided here. The illustrations provided are intended to demonstrate a general concept, and are not intended to define the breadth of outcomes possible when using this device and method.

Although one embodiment of the invention has been illustrated, it will be appreciated that there are many modifications and variations of the present invention. It is the intent of the appended claims to cover all modifications and variations which fall within the true spirit and scope of the invention.

What is claimed:

1. A device for styling hair, the device comprising a hollow first cylinder, the first cylinder comprising a longitudinal axis coincident with its longitudinal centerline, a top end, a bottom end, and a mid portion extending between said top end and said bottom end, the first cylinder comprising a wall, the wall having an inner surface and an outer surface, the wall having a longitudinally aligned split, said split allowing said first cylinder to be opened to include strands of hair, said split resulting in first and second edges, wherein when said first cylinder is in said cylindrical configuration said first edge abuts said second edge and said wall has an uninterrupted, cylindrical shape, and wherein when said first cylinder is openable to where said first edge is separated from said second edge whereby said device can be positioned around strands of hair, a cinch comprising a thin band which encircles said cylinder when said first cylinder is in said cylindrical configuration, said cinch being formed of a rigid, semi-flexible material which maintains a circular configuration rather than generally planar configuration when not forcibly held in said generally planar configuration, and said cinch, when in place encircling the first cylinder, reinforcing said securement means by preventing said first edge from separating from said second edge.

2. The device of claim 1 wherein the inner surface of said first cylinder is provided with at least one tine extending from said inner surface in a radially inward direction, said at least one tine positioned adjacent said bottom end.

3. The device of claim 2 wherein said first and second edges are provided with securement means which allow said device to be selectively secured in said cylindrical configuration.

4. The device of claim 3 wherein said securement means comprises said first edge being provided with at least one circumferentially extending tab, and where said second edge is provided with at least one circumferentially extending recess which is sized and shaped to receive said at least one tab therewithin, said at least one recess being aligned with said at least one tab such that when said device is in said cylindrical configuration, said at least one tab resides within said at least one recess.

5. The device of claim 4 wherein said at least one tab and said at least one recess are provided with corresponding respective shapes so as to allow said at least one tab to be snap-fit within said at least one recess.

6. The device of claim 5 wherein said cylinder is provided with a diameter which tapers from said bottom end to said top end.

7. The device of claim 5 wherein said device further comprises an overlay, said overlay comprising a second hollow cylinder, the second cylinder comprising an overlay wall, the overlay wall having an inner surface and an outer surface, the overlay wall having a longitudinally aligned split, said split allowing said second cylinder to be opened to a generally planar, rectangular configuration, the second cylinder being formed of a rigid, semi-flexible material which maintains a cylindrical configuration rather than generally planar configuration when not forcibly held in said generally planar configuration, said spit resulting in first and second overlay edges, wherein when said second cylinder is in said cylindrical configuration said first overlay edge is adjacent to said second overlay edge and said overlay wall has a cylindrical shape, and wherein when said second cylinder is forced open to a generally planar configuration said first overlay edge is separated from said second overlay edge by said mid portion of said second cylinder, said second cylinder being placed in an overlaying relationship with said first cylinder such that said second cylinder surrounds said first cylinder, said second cylinder being sized such that the outer surface of said first cylinder confronts and lies in contact with the inner surface of said second cylinder, said second cylinder sized such that the first cylinder is completely obscured by the second cylinder when the second cylinder overlies the first cylinder.

8. The device of claim 7 wherein the wall of the first cylinder is provided with a plurality of first holes and a plurality of second holes, all of said first holes and said second holes extending completely through said wall, said first holes having a diameter which is sized to receive the tip of a hair hook therethrough, said second holes having a diameter sized to fittingly receive the stud portion of a decorative ornament and being much smaller in diameter than said first holes, and wherein the overlay wall of the second cylinder is provided with a plurality of first overlay holes and a plurality of overlay second holes, all of said first overlay holes and said second overlay holes extending completely through said overlay wall, said first overlay holes having a diameter which is sized to receive the tip of a hair hook therethrough and being positioned on the overlay so as to overlie and be aligned with said first holes in said first cylinder when the overlay lies in an overlying manner about said cylinder such that the overlay inside surface is in a confronting adjacent relationship with the outside surface of the first cylinder, said second overlay holes having a diameter sized to fittingly receive the stud portion of a decorative ornament and being much smaller in diameter than said first holes, and being positioned on the overlay so as to overlie and be aligned with said second holes in said first cylinder when the overlay lies in an overlying manner about said first cylinder such that the overlay inside surface is in a confronting adjacent relationship within the outside surface of the first cylinder.

9. The device of claim 1 wherein said outer surface of said wall of said first cylinder is provided with a groove, said groove extending circumferentially about said first cylinder and being positioned adjacent said top end, said cinch comprising an inner surface and an outer surface, said groove sized to receive said cinch therewithin such that said outer surface of said cinch lies flush with said outer surface of said wall of said first cylinder.

10. A method for using a hair styling tool to create an up do hair style, the hair styling tool being used in combination with a hair hook and an elastic band, the hair styling tool comprising a hollow first cylinder, the first cylinder comprising a longitudinal axis coincident with its longitudinal centerline, a top end, a bottom end, and a mid portion extending between said top end and said bottom end, the first cylinder comprising a wall, the wall having an inner surface and an outer surface, the wall having a longitudinally aligned split, said split allowing said first cylinder to be opened, said split resulting in first and second edges, wherein when said first cylinder is in said cylindrical configuration said fist edge abuts said second edge and said wall has an uninterrupted, cylindrical shape, and wherein when said first cylinder is forced open to said first edge is separated from said second edge, wherein the bottom end of said first cylinder is provided with at least one tine extending from said inner surface in a radially inward direction, wherein said first and second edges are provided with securement means which allow said device to be selectively secured in said cylindrical configuration, wherein the wall of the first cylinder is provided with a plurality of first holes land a plurality of second holes, all of said first holes and said second holes extending completely through said wall, said first holes having a diameter which is sized to receive the tip of said hair hook therethrough, said second holes having a diameter sized to fittingly receive the stud portion of an earring, the method steps comprising, 1. gathering a portion of hair together,
2. maintaining the portion of hair in a gathered relationship and surrounding the portion of hair with said elastic band, the elastic band being placed about said portion of hair adjacent to the scalp of the head of the wearer,
3. opening said first cylinder such that the securement means are detached,
4. placement of said first cylinder about said gathered portion of hair by surrounding the gathered portion of hair with said first cylinder in its cylindrical configuration such that the gathered portion of hair resides within and extends in parallel with the longitudinal centerline of first cylinder, said first cylinder oriented on the gathered portion of hair such that said bottom end resides adjacent the scalp and the said at least one tine extends into the gathered portion of hair such that it resides between the elastic band and said scalp,
5. securement of said secure men means such that said fist edge of said first cylinder is maintained in an abutting relationship with said second edge of said first cylinder,
6. insertion of said hair hook through one of said first holes,
7. insertion of said hair hook through one of said first holes,
8. withdrawing said hair hook along with the hooked strands of hair from said one of first holes,
10. repetition of steps 6–8 until strands of hair have been withdrawn from as many of said first holes as required by the desired style.

11. The method of claim 10 wherein said securement means comprises said first edge being provided with at least one circumferentially extending tab, and wherein said second edge is provided with at least one circumferentially extending recess which is sized and shaped to receive said at least one tab therewithin, said at least one recess as being aligned with said at least one tab such that when device is in said cylindrical configuration, said at least one tab resides within said at least one recess, and wherein said at least one tab and said at least one recess are provided with corresponding respective shapes so as to allow said at least one tab to be snap-fit within said at least one recess.

12. The method of claim 11 wherein said hair styling tool further comprises an overlay, said overlay comprising a second hollow cylinder, the second cylinder comprising an overlay wall, the overlay wall having an inner surface and an outer surface, the overlay wall having a longitudinally aligned split, said split allowing said second cylinder to be opened to a generally planar, rectangular configuration, the second cylinder being formed of a rigid, semi-flexible material which maintains a cylindrical configuration rather than generally planar configuration when not forcibly held in said generally planar configuration, said split resulting in first and second overlay edges, wherein when said second cylinder is in said cylindrical figuration said first overlay edge is adjacent to said second overlay edge and said overlay wall has a cylindrical shape, and wherein when said second cylinder is forced open to a generally planar configuration said first overlay edge is separated from said second overlay edge by said mid portion of said second cylinder, wherein the overlay wall of the second cylinder is provided with a plurality of first overlay holes and a plurality of overlay second holes, all of said first overlay holes and said second overlay holes extending completely through said overlay wall, said first overlay holes having a diameter which is sized to receive the top of a hair hook therethrough and being positioned on the overlay so as to overlie and be aligned with said first holes in said first cylinder when the overlay lies in an overlying manner about said first cylinder such that the overlay inside surface is in a confronting adjacent relationship with the outside surface of the first cylinder, said second overlay holes having a diameter sized to fittingly receive the stud portion of a decorative ornament and being much smaller in diameter than said first holes, and being positioned on the overlay so as to overlie and be aligned with said second holes in said first cylinder when the overlay lies in an overlying manner about said first cylinder such that the overlay inside surface is in a confronting adjacent relationship with the outside surface of the first cylinder, wherein said following method step 5.5 is inserted before method step 6:

5.5 placement of said second cylinder in an overlying relationship with said first cylinder such that said second cylinder surrounds said first cylinder, said second cylinder being sized such that the outer surface of said first cylinder confronts and lies in contact with the inner surface of said second cylinder, said second cylinder sized such that the first cylinder is completely obscured by the second cylinder when the second cylinder overlies the first cylinder.

13. The method of claim 11 wherein said hair styling tool further comprises a cinch, said cinch comprising a thin band which encircles said first cylinder when said first cylinder is in said cylindrical configuration, said cinch being formed of a rigid, semi-flexible material which maintains a circular configuration rather than generally linear configuration when not forcibly held in said generally linear configuration, said cinch, when in place encircling the first cylinder, reinforcing said securement means by preventing said first edge from separating from second edge, wherein the following method steps 10–12 are added following method step 9:

10. open said cinch to a generally linear configuration,
11. place said cinch adjacent said first cylinder,
12. release said cinch, allowing the cinch to return to its circular configuration and encircling said first cylinder.

14. A kit for creating an up do hair style, the kit providing plural devices which can be used individually, or can be used in combination to create an infinite variety of attractive hair styles, the kit comprising the following elements:

1. at least one hair hook styling apparatus,
2. at least one hair hook,
3. at least three blank overlays,
4. one instruction booklet, wherein said hair styling apparatus comprises a hollow first cylinder, the first cylinder comprising a longitudinal axis coincident with its longitudinal centerline, a top end, a bottom end, and a mid portion extending between said top end and said bottom end, the first cylinder comprising a wall, the wall having an inner surface and an outer surface, the wall having a longitudinally aligned split, said split allowing said first cylinder to be opened to a generally planar, rectangular configuration, the first cylinder being formed of a rigid, semi-flexible material which maintains a cylindrical configuration rather than generally planar configuration when not forcibly held in said generally planar configuration, said split resulting in first and second edges, wherein when said first cylinder is in said cylindrical configuration said first edge abuts said second edge and said wall has an uninterrupted, cylindrical shape, and wherein when said first cylinder is forced open to a generally planar configuration said first edge is separated from said second edge by said mid portion of said first cylinder.

15. The kit of claim 14 wherein the kit further comprises at least one hollow cylindrical foam form and at least one elongate rod foam form.

16. The kit of claim 14 wherein the kit further comprises at least one faux pony tail and one or more hair plugs.

17. The kit of claim 14 wherein the kit further comprises at least one cinch.

18. The kit of claim 14 wherein the kit further comprises one Topsy Tail™.

19. A device for styling hair, the device comprising a hollow first cylinder, the first cylinder comprising a longitudinal axis coincident with its longitudinal centerline, a top end, a bottom end, and a mid portion extending between said top end and said bottom end, the first cylinder comprising a wall, the wall having an inner surface and an outer surface, the wall having a longitudinally aligned split, said split allowing said first cylinder to be opened to include strands of hair, said split resulting in first and second edges, wherein when said first cylinder is in said cylindrical configuration said first edge abuts said second edge and said wall has an uninterrupted, cylindrical shape, and wherein when said first cylinder is openable to where said first edge is separated from said second edge whereby said device can be positioned around strands of hair, said wall of said first cylinder being provided with a plurality of first holes and a plurality of second holes, all of said first holes and said second holes extending completely through said wall, said first holes having a diameter which is sized to receive the tip of a hair hook therethrough, said second holes having a diameter sized to fittingly receive the stud portion of a decorative ornament and being much smaller in diameter than said first holes.

* * * * *